US007059234B2

(12) United States Patent
Husseini

(10) Patent No.: US 7,059,234 B2
(45) Date of Patent: Jun. 13, 2006

(54) AMMUNITION ARTICLES AND METHOD OF MAKING AMMUNITION ARTICLES

(75) Inventor: Nabil Husseini, Plattsburgh, NY (US)

(73) Assignee: Natec, Inc., Plattsburgh, NY (US)

( * ) Notice: Subject to any disclaimer, the term of this patent is extended or adjusted under 35 U.S.C. 154(b) by 0 days.

(21) Appl. No.: 10/853,754

(22) Filed: May 26, 2004

(65) Prior Publication Data

US 2005/0081704 A1 Apr. 21, 2005

Related U.S. Application Data

(60) Provisional application No. 60/473,927, filed on May 29, 2003.

(51) Int. Cl.
*F42B 33/00* (2006.01)

(52) U.S. Cl. ..... 86/55

(58) Field of Classification Search ..... 86/55, 86/54, 23, 19.5

See application file for complete search history.

(56) References Cited

U.S. PATENT DOCUMENTS

| | | | | |
|---|---|---|---|---|
| 123,352 | A | 2/1872 | Milbank | |
| 2,041,253 | A | 5/1936 | Leussler | |
| 2,336,065 | A | 12/1943 | Cadham | |
| 2,654,319 | A | 10/1953 | Roske | |
| 2,862,446 | A | 12/1958 | Ringdal | |
| 2,983,224 | A * | 5/1961 | Prosen et al. | 102/522 |
| 2,987,775 | A | 6/1961 | Albrecht et al. | |
| 3,026,802 | A | 3/1962 | Barnet et al. | |
| 3,031,966 | A | 5/1962 | Metzger | |
| 3,099,958 | A | 8/1963 | Daubenspeck et al. | |
| 3,144,827 | A | 8/1964 | Boutwell | |
| 3,424,089 | A | 1/1969 | Humpherson | |
| 3,553,804 | A | 1/1971 | Kopsch et al. | |
| 3,559,581 | A | 2/1971 | Kriz et al. | |
| 3,628,225 | A | 12/1971 | Parker | |
| 3,745,924 | A | 7/1973 | Scanlon | |
| 3,786,755 | A | 1/1974 | Eckstein et al. | |
| 3,842,739 | A | 10/1974 | Scanlon et al. | |
| 3,874,294 | A | 4/1975 | Hale | |
| 3,897,527 | A | 7/1975 | Ringdal | |
| 3,935,816 | A | 2/1976 | Boquette, Jr. | |
| 3,955,506 | A | 5/1976 | Luther et al. | |
| 3,977,326 | A | 8/1976 | Anderson et al. | |
| 3,990,366 | A | 11/1976 | Scanlon | |
| 4,020,763 | A | 5/1977 | Iruretagoyena | |
| 4,054,637 | A | 10/1977 | Gruaz | |
| 4,140,058 | A | 2/1979 | Ballreich et al. | |

(Continued)

FOREIGN PATENT DOCUMENTS

| | | |
|---|---|---|
| CH | 326592 | 2/1958 |

(Continued)

OTHER PUBLICATIONS

"Design, Analysis and Testing of a 5.56mm Polymer Cartridge Case", Dr. Nabil Husseini et al., May 15, 2002.*

*Primary Examiner*—Troy Chambers
(74) *Attorney, Agent, or Firm*—Buchanan Ingersoll PC

(57) ABSTRACT

A method of manufacturing an ammunition article, includes forming a projectile of an ammunition article at a first station of an apparatus, transporting the projectile within the apparatus to a second station of the apparatus, and injection molding at the second station a cartridge casing body of the ammunition article around at least a portion of the projectile. An apparatus for making an ammunition articles is also disclosed.

10 Claims, 13 Drawing Sheets

U.S. PATENT DOCUMENTS

| | | | | |
|---|---|---|---|---|
| 4,147,107 | A | | 4/1979 | Ringdal |
| 4,192,233 | A | | 3/1980 | Dumortier |
| 4,239,006 | A | | 12/1980 | Kelson |
| 4,314,954 | A | | 2/1982 | Ringdal |
| 4,383,468 | A | | 5/1983 | Sie et al. |
| 4,387,492 | A | | 6/1983 | Inman |
| 4,455,942 | A | | 6/1984 | Murray et al. |
| 4,508,036 | A | | 4/1985 | Jensen et al. |
| 4,565,131 | A | | 1/1986 | Buchner |
| 4,569,288 | A | | 2/1986 | Grelle et al. |
| 4,572,078 | A | | 2/1986 | Bell |
| 4,593,621 | A | | 6/1986 | Buchner |
| 4,614,157 | A | | 9/1986 | Grelle et al. |
| 4,726,296 | A | | 2/1988 | Leshner et al. |
| 4,738,202 | A | | 4/1988 | Hebert |
| 4,809,612 | A | | 3/1989 | Ballreich et al. |
| 4,928,598 | A | | 5/1990 | Sabranski et al. |
| 5,021,206 | A | | 6/1991 | Stoops |
| 5,033,386 | A | | 7/1991 | Vatsvog |
| 5,131,123 | A | | 7/1992 | Brooks |
| 5,151,555 | A | | 9/1992 | Vatsvog |
| 5,239,928 | A | | 8/1993 | Ricci |
| 5,259,288 | A | | 11/1993 | Vatsvog |
| 5,535,495 | A | * | 7/1996 | Gutowski ..... 86/54 |
| 5,592,986 | A | | 1/1997 | Auger et al. |
| 5,943,749 | A | | 8/1999 | Swank |
| 6,041,712 | A | | 3/2000 | Lyon |
| 6,237,494 | B1 | | 5/2001 | Brunet et al. |
| 6,752,084 | B1 | * | 6/2004 | Husseini et al. ..... 102/466 |
| 6,845,716 | B1 | * | 1/2005 | Husseini et al. ..... 102/466 |
| 6,874,402 | B1 | * | 4/2005 | Ettmueller ..... 86/53 |
| 2002/0177531 | A1 | | 11/2002 | Shepherd |

FOREIGN PATENT DOCUMENTS

| | | |
|---|---|---|
| EP | 0 131 863 A2 | 1/1985 |
| GB | 1 015 516 | 1/1966 |
| GB | 2 044 416 A | 10/1980 |
| WO | WO 89/07496 | 8/1989 |

* cited by examiner

AMMUNITION ARTICLES AND METHOD OF MAKING AMMUNITION ARTICLES

CROSS-REFERENCE TO RELATED APPLICATIONS

This application claims the benefit of Provisional Application No. 60/473,927, filed in the United States on May 29, 2003, the entire contents of which are incorporated herein by reference.

BACKGROUND AND SUMMARY

The present invention relates to ammunition articles and a method and apparatus for manufacturing ammunition articles.

U.S. patent application Ser. No. 09/265,946, entitled "AMMUNITION ARTICLES WITH PLASTIC COMPONENTS AND METHOD OF MAKING AMMUNITION ARTICLES WITH PLASTIC COMPONENTS", filed Mar. 11, 1999, naming inventors Nabil Husseini and David Byron, and U.S. patent application Ser. No. 09/832,020, entitled "AMMUNITION ARTICLES WITH PLASTIC COMPONENTS AND METHOD OF MAKING AMMUNITION ARTICLES WITH PLASTIC COMPONENTS", filed Apr. 11, 2001, naming inventors Nabil Husseini and David Byron, and published as US 2001/00113299 A1 on Aug. 16, 2001, both of which are incorporated by reference, disclose ammunition articles and a method of and equipment for making ammunition articles with plastic components wherein plastic is injection molded around a projectile or other portion of the ammunition article, such as to form a cartridge casing for the ammunition article. Though this type of ammunition article, method, and equipment can result in substantial savings relative to conventional ammunition articles, manufacturing methods, and manufacturing equipment, it is desirable to further speed the manufacture and reduce manufacturing costs.

In accordance with an aspect of the present invention, a method of manufacturing an ammunition article includes forming a projectile of an ammunition article at a first station of an apparatus, transporting the projectile within the apparatus to a second station of the apparatus, and injection molding at the second station a cartridge casing body of the ammunition article around at least a portion of the projectile In accordance with another aspect of the present invention, an apparatus for making an ammunition article includes a first station for forming a projectile, a second station for injection molding a cartridge casing body around at least a portion of the projectile, and a conveyor for transporting the projectile from the first station to the second station.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
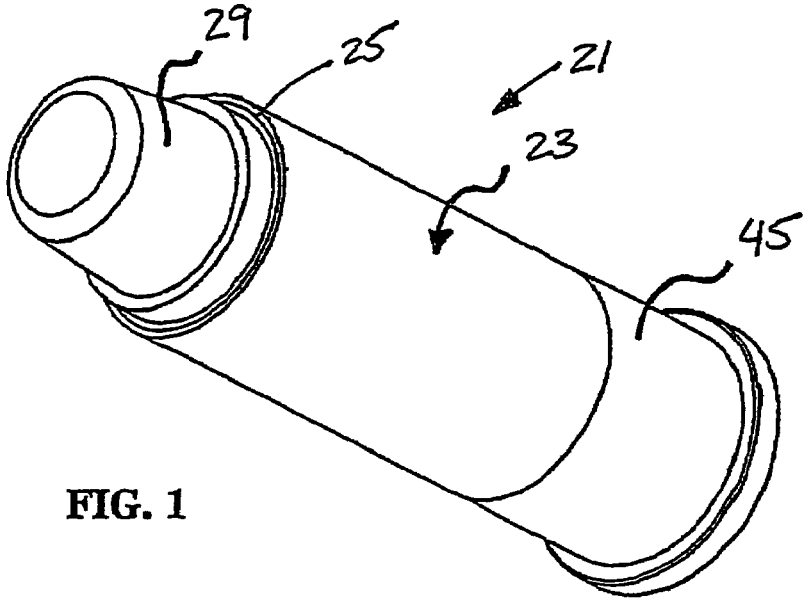
FIG. 1 is a top perspective view of an ammunition article according to a first embodiment of the present invention.
Figure 2:
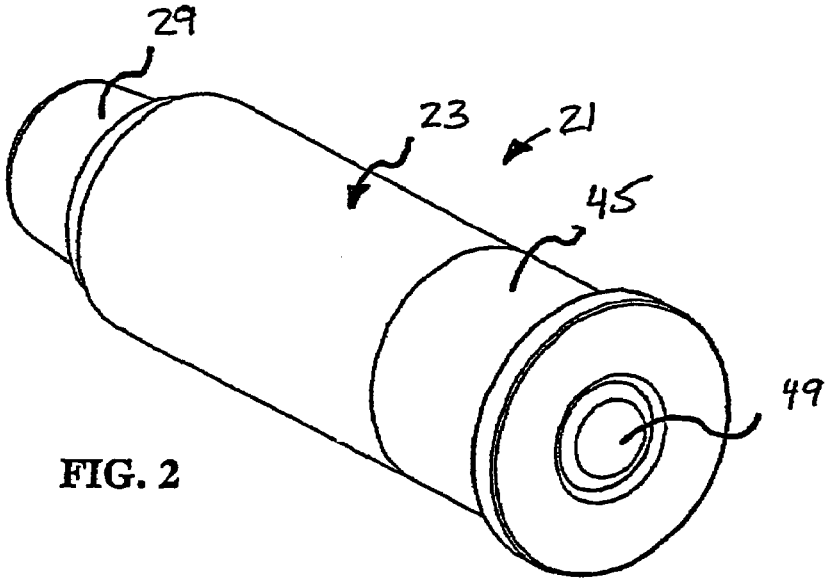
FIG. 2 is a bottom perspective view of an ammunition article according to the first embodiment of the present invention.
Figure 3:
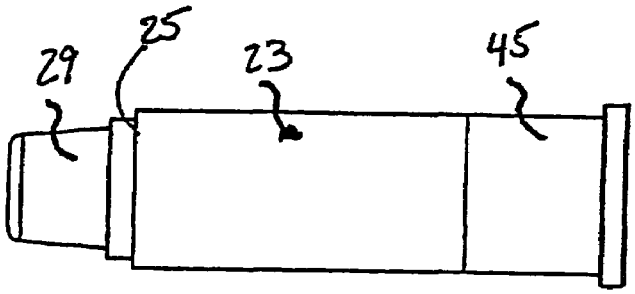
FIG. 3 is a side view of an ammunition article according to the first embodiment of the present invention.
Figure 4A:
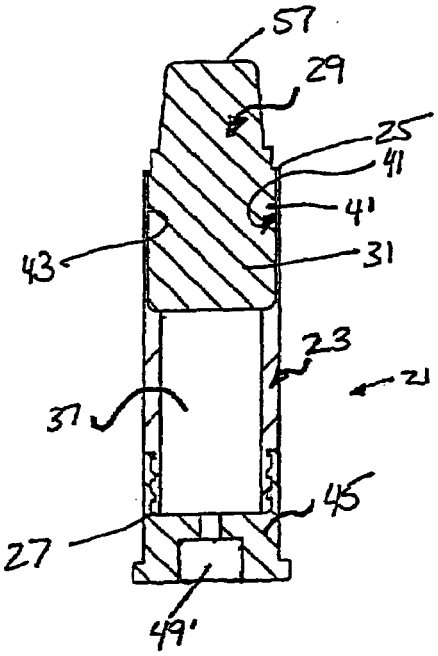
FIGS. 4A and 4B are side, cross-sectional views of an ammunition article according to the first embodiment of the present invention.

An ammunition article 21 according to an embodiment of the present invention is shown in FIGS. 1–3. As seen in cross-section in FIGS. 4A and 4B, the ammunition article 21 includes a molded plastic cartridge casing body 23 having a first end 25 and a second end 27. A projectile 29 is attached to the first end 25 of the cartridge casing body 23. The cartridge casing body 23 is a molded plastic part, and is formed by plastic being molded around at least a portion 31 of the projectile 29. As discussed with reference to FIG. 24, if desired or necessary, the cartridge casing body may be formed by plastic being molded to conform only with a bottom of a projectile, with a plastic protrusion extending into a cavity in the bottom of the projectile. The projectile 29 is preferably any one of the wide variety of well-known projectiles but may, if desired or necessary, include one or more features useful in connection with the present invention.

Figure 5:
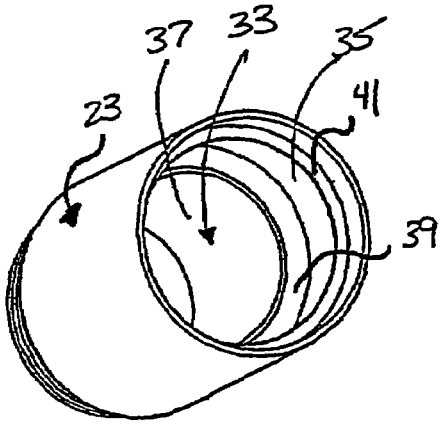
FIG. 5 is a top perspective view of a cartridge casing body according to the first embodiment of the present invention and illustrated without the projectile.
Figure 6:
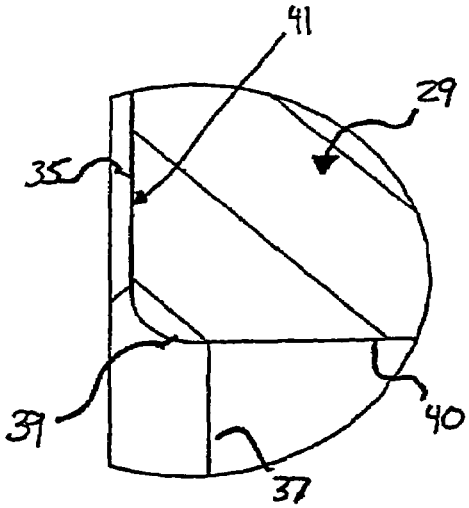
FIG. 6 is a cross-sectional view of a portion of an ammunition article according to the first embodiment of the present invention.
Figure 7:
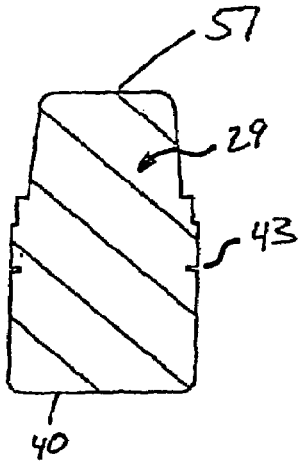
FIG. 7 is a cross-sectional view of an embodiment of a projectile for use in connection with the ammunition article according to the first embodiment of the present invention.
Figure 8:
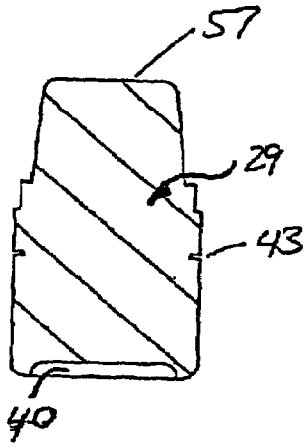
FIG. 8 is a cross-sectional view of another embodiment of a projectile for use in connection with the ammunition article according to the first embodiment of the present invention.

As seen in FIG. 5 (showing the cartridge casing body with the projectile removed for illustration) the cartridge casing body 23 preferably includes an interior volume 33 including a first interior portion 35 defined by the portion 31 of the projectile 29 and a second interior portion 37 having a smaller diameter than the first interior portion and being separated from the first interior portion by a shoulder 39. As seen in FIGS. 5 and 6, the shoulder 39 is preferably of sufficient size to prevent axial movement of the projectile 29 into the second interior portion 37. The second interior volume 37 is preferably formed by a core pull (FIGS. 13A–14B) used in a cartridge casing body molding operation wherein a leading end of the core pull preferably abuts against the base 40 of the projectile 29. As seen in FIG. 7, the base 40 of the projectile may be flat or, as seen in FIG. 8, contoured, such as by being concave. The base 40 may be contoured to any shape desired or necessary, such as concave, convex, a combination of concave or convex, have straight portions, or curved portions, depending upon factors such as the ballistic requirements of the projectile.

The projectile 29 is preferably attached to the cartridge casing body 23 by one or more attachment arrangements 41 directed to preventing axial movement of the projectile relative to the cartridge casing body prior to firing, such as during storage or shipment, and during accidents such as dropping of the ammunition article. Depending upon the type of ammunition article being manufactured, desirable characteristics of the attachment arrangement 41 may include the ability to provide sufficient bullet pull to permit creation of neither too much nor too little chamber pressure during firing of the projectile, ensuring uniform bullet pull from round to round, and avoiding causing portions of the cartridge casing body to break off when the ammunition article is fired. Suitable attachment arrangements 41 include a heat bond, an adhesive bond, and a weld, such as an ultrasonic weld, between the portion 31 of the projectile and the cartridge casing body 23. The attachment arrangement may be a mechanical attachment arrangement wherein portions of the cartridge casing body 23 and the portion 31 of the projectile 29 are caused to interconnect. The attachment arrangement may, of course, be nothing more than a metal to plastic bond between the portion 31 of the projectile 29 and the cartridge casing body 23 created during the molding operation.

Figure 9A:
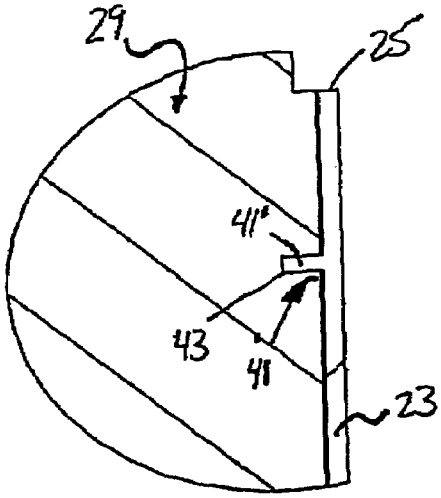
FIG. 9A is a cross-sectional view of a portion of an ammunition article according to the first embodiment of the present invention.
Figure 9B:
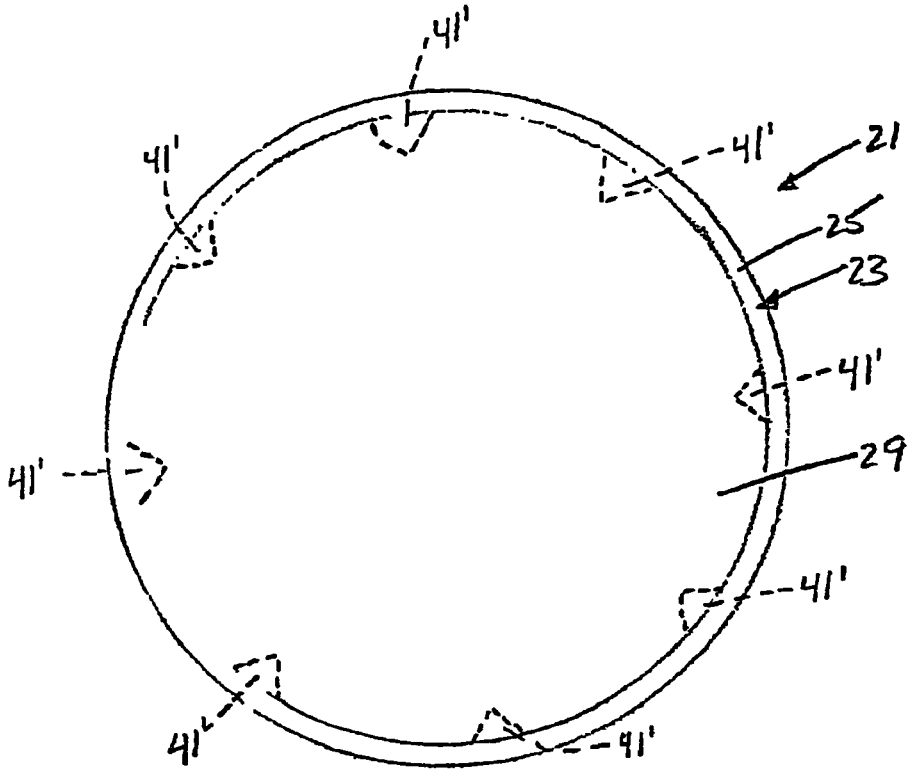
FIGS. 9B and 9C are partial, top views of a portion of an ammunition article according to the first embodiment of the present invention, showing possible forms of flanges.
Figure 9C:
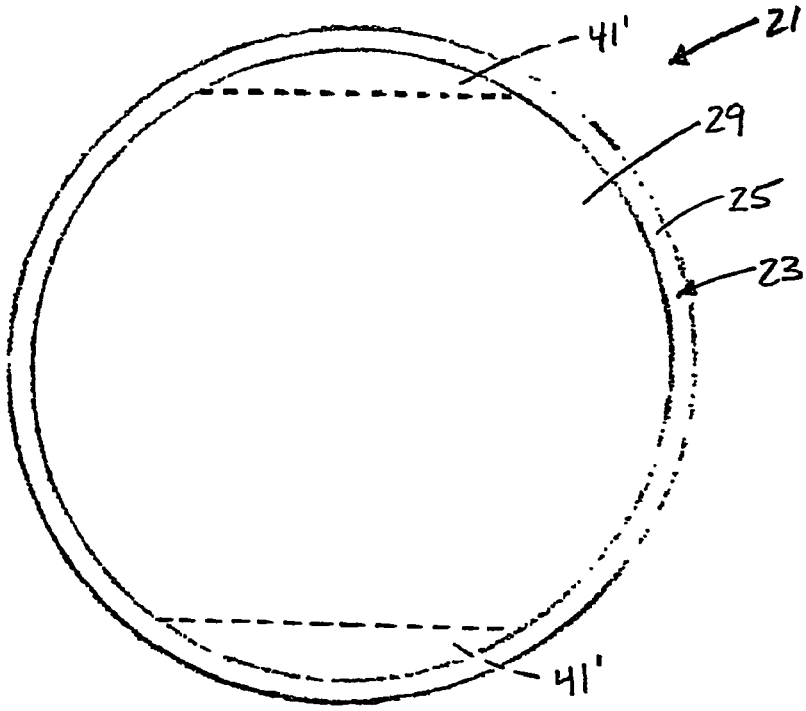

A form of attachment arrangement 41, seen in detail in FIG. 9A, includes a flange 41' on the cartridge casing body 23 extending into a recess 43 in the projectile 29. Optimal dimensions for the flange 41' will vary depending upon the specific type of ammunition article 21 to be made. When the cartridge casing body 23 is made of a modified ZYTEL resin, available from E.I. DuPont De Nemours Co., a modified 612 nylon resin, modified to increase elastic response, and the ammunition article is so-called "38 Special" type ammunition, a desirable dimension for an annular flange 41' is 0.009" thick by 0.020" wide, i.e., the recess 43 is an annular recess in the projectile 29 that is about 0/009" thick by 0.020" wide. The flange 41' and the recess 43 are not limited to being annular, and can be any of a variety of shapes and sizes, such as pins and grooves, detents and detent receiving recesses, helixes, such as screw threads, or any other suitable mechanically interconnectable structure sufficient to retain the projectile 29 in position in the cartridge casing body 23. By proper selection of materials and flange 41' and recess 43 size, it is possible to design to a very exact degree features of the ammunition article 21 such as bullet pull. As seen in FIGS. 9B and 9C, the flange 41' need not be continuous around the entire circumference of the projectile, such as in the embodiment shown in FIG. 5, but may be in the form of multiple, discontinuous or interrupted forms. The shape of the flange 41' may be any suitable shape, such as a cone, a pyramid, a half-sphere, a half circular cylinder, a cube, or other geometrical form.

Figure 10:
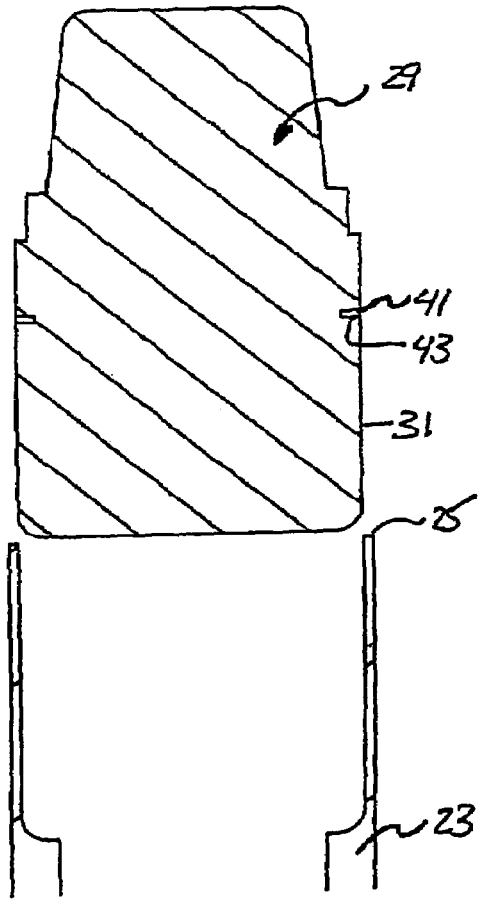
FIG. 10 is a cross-sectional view of a portion of an embodiment of the ammunition article according to the first embodiment of the present invention shown after firing.
Figure 11:
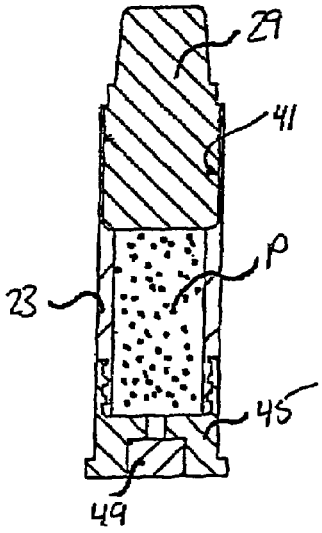
FIG. 11 is a cross-sectional view of an embodiment of the ammunition article according to the first embodiment of the present invention.

As seen in FIG. 10, the flange 41', when provided, is preferably sized such that, and the cartridge casing body 23 is preferably made of a plastic material suitable for its specific intended application such that, upon firing of the projectile 29, the flange 41' breaks off from the rest of the body 23 and is carried off with the projectile, without also causing other portions of the body 23 to break off. If desired or necessary, multiple flanges 41 and recesses 43 can be arranged along a length of the cartridge casing body 23 and the portion 31 of the projectile 29. It will be understood that an ammunition article 21 with a flange 41' is just one embodiment of the present invention, and that the flange may be omitted in favor of one or more alternative attachment arrangements, such as metal-plastic bonding from the molding operation, interference fit, heat bonding, adhesive, or ultrasonic welding, as seen in FIG. 11.

The ammunition article 21 preferably also includes a base 45 attached to the second end 27 of the cartridge casing body 23. One suitable material for the cartridge casing body 23 is a modified ZYTEL resin, available from E.I. DuPont De Nemours Co., a modified 612 nylon resin, modified to increase elastic response. In embodiments of the present invention wherein a molded cartridge casing body may be provided, a suitable cartridge casing body may also be made of a moldable material that forms part of the propellant pack, i.e., a moldable propellant, or otherwise is itself combustible or consumable by a propellant such as a powder ignition. The base 45 may be made of any suitable conventional material, for example, a metal material such as brass. According to one embodiment of the present invention, the base 45 is made of a plastic material, and is preferably molded out of a long fiber reinforced nylon material to provide great stiffness, high compressive strength, and minimal cold flow, although other well known materials may be used for the base. As desired or necessary, the base may be a metal base, such as a brass base, or a plastic material base, a ceramic base, a composite base, a combination of plastic, composite, or ceramic, or may incorporate the composite reinforced ceramic technology disclosed in U.S. patent application Ser. No. 08/590,621, which is expressly incorporated by reference. If desired or necessary, the base 45 and the cartridge casing body 23 can be made of the same material. For at least some applications, the cartridge casing body 23 is preferably somewhat more flexible than the base 45 to facilitate creation of a gas seal with the chamber, but fracture properties are preferably such as to facilitate breaking off of a flange 41' (if provided) relatively cleanly from the rest of the cartridge casing body without causing other parts of the cartridge casing body to break off and follow the projectile 29 during firing. Preferably, the base 45 is sufficiently sturdy to be reusable, even when it may be necessary to replace the cartridge casing body 23 after each use.

Figure 12:
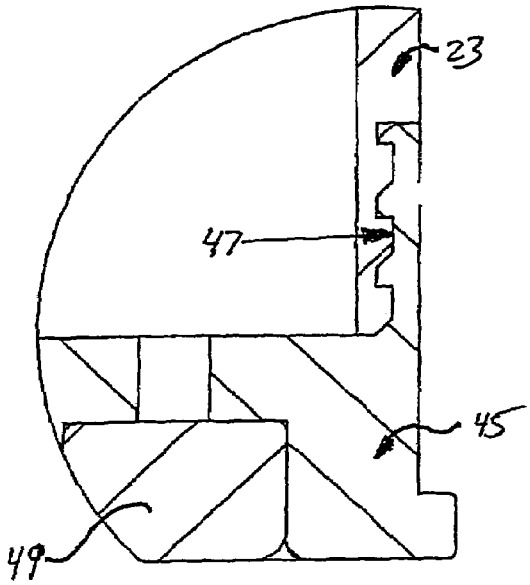
FIG. 12 is a cross-sectional view of a portion of an ammunition article according to the first embodiment of the present invention.

The base 45 is attached to the cartridge casing body 23 by any suitable attachment arrangement, or combination of attachment arrangements. As seen in FIG. 12, the base 45 may be attached to the cartridge casing body 23 by a suitable attachment arrangement 47, such as by a mechanically interconnecting structure or otherwise. Suitable attachment arrangements 47 may include, for example, screw threads, a tongue and groove arrangement, flanges or pins and grooves, detent and detent receiving recesses, an interference fit, a heat bond, an adhesive, or an ultrasonic weld, or a combination of these attachment arrangements.

Figure 4B:
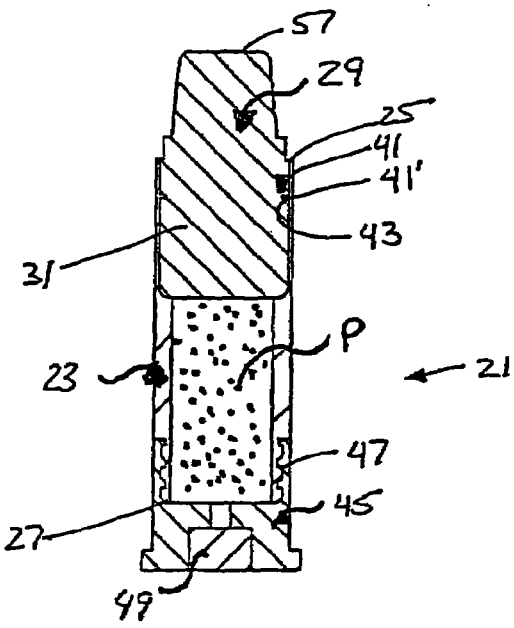

As seen in FIG. 4B, the ammunition article 21 preferably includes a propellant charge P inside the cartridge casing body 23. A variety of propellant charge types are well known and, for purposes of the present application and except where otherwise indicated, can be considered to broadly include all suitable types of charges, such as those that are conventionally thought of as propellant charges and those that are conventionally considered to be explosive charges, such as black powder charges or charges such as PYRODEX, a smokeless black powder substitute available from Hodgdon Powder Co., Inc., Shawnee Mission, Kans. Depending upon the type of ammunition article 21, the ammunition article may include some means for igniting the propellant, such as a primer 49 (FIG. 4B) for igniting the propellant, or an electronic ignition 49' for igniting the propellant (shown schematically in FIG. 4A), or means for igniting the propellant may be partially or completely external to the ammunition article.

Figure 13A:
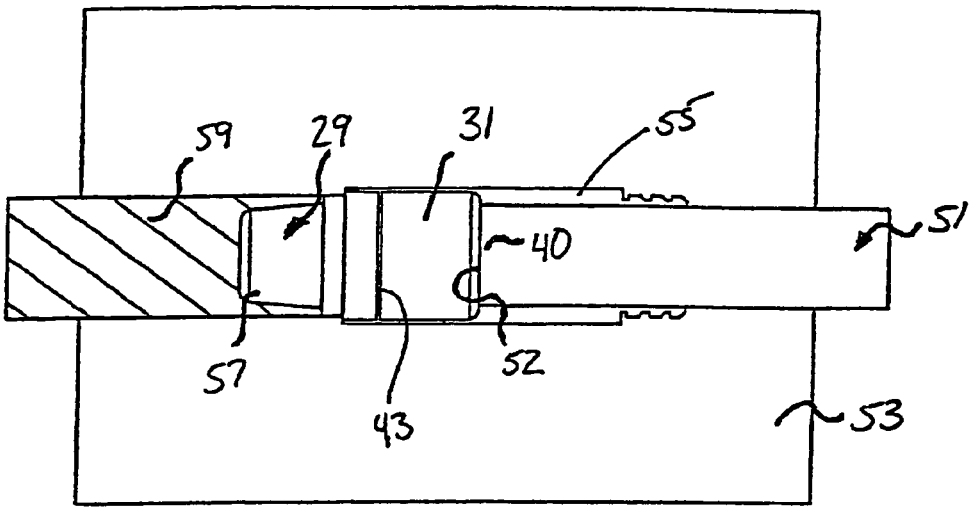
FIGS. 13A–14B are partially cross-sectional views of molding equipment for making an embodiment of a cartridge casing body for an ammunition article according to the first embodiment of the present invention.

As seen in FIG. 13A, the cartridge casing body 23 is preferably made by molding plastic around at least the portion 31 of the projectile 29 to form the plastic cartridge casing body having the first end 25 to which the projectile is attached and a second end 27. Numerous plastic molding techniques are well known and are suitable for use in connection with the present application. The plastic is preferably molded around a core pull 51 such that the core pull and the portion 31 of the projectile 29 define the interior volume 33 of the plastic cartridge casing body 23. A leading end 52 of the core pull 51 preferably abuts against the base 40 of the projectile 29. After molding, the core pull 51 is removed from the plastic cartridge casing body 23. Preferably, the core pull 51 has a smaller diameter than the portion 31 of the projectile such that the interior volume 33 of the cartridge casing body 23 includes the first interior portion 35 defined by the portion of the projectile and a second interior portion 37 having a smaller diameter than the first interior portion and being separated from the first interior portion by the shoulder 39. The shoulder 39 is preferably of sufficient size to prevent axial movement of the projectile 29 into the second interior portion 37.

If desired or necessary, one or more attachment arrangements above and beyond the metal-plastic bond developed upon molding the plastic of the plastic cartridge casing body 23 around the portion 31 of the projectile 29 may be provided. The attachment arrangement 41 can be provided by, for example, heat bonding the projectile to the cartridge casing body, by adhesive bonding of the projectile to the cartridge casing body, or ultrasonic welding of the cartridge casing body to the projectile. The attachment arrangement may be provided by providing one or more recesses 43 in the portion 31 of the projectile 29 such that, when the plastic is molded around the portion of the projectile, the plastic enters the recesses and forms what is referred to herein as a flange 41' on the cartridge casing body 23, the flange 41' extending into the recess.

Figure 13B:
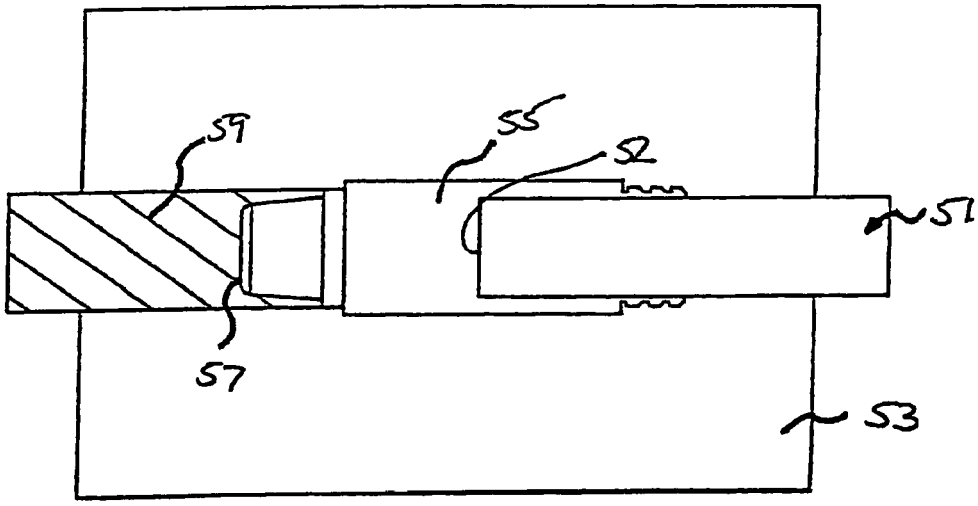
Figure 13C:
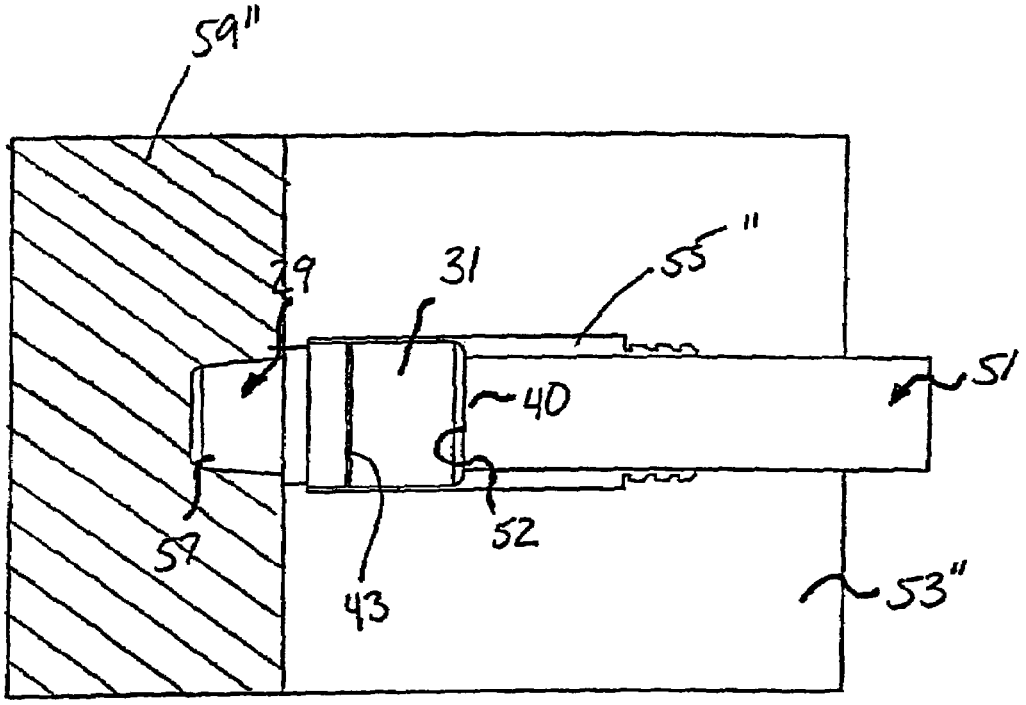

As seen in FIGS. 13A and 13B, the molding operation is preferably performed in a mold 53 (showing a half mold and not showing another half of the mold which is preferably symmetrical to the illustrated half mold). The mold 53 preferably includes a cavity 55 in which the core pull 51 is axially movable to a position in which the leading end of the core pull preferably abuts against the base 40 of the projectile 29. As seen in FIG. 13A, a front end 57 of the projectile 29 is preferably positioned against a mold element 59 corresponding in shape to the front end of the projectile, and which ensures proper axial positioning of the projectile relative to walls of the cavity 55. The mold element 59 may be integral with the mold 53, or may be a separate part that may be movable, as desired or necessary. An alternative form of mold 53" is shown in FIG. 13C, wherein a stationary or movable element 59" is substituted for the mold element 59, and receives a front end of the projectile for axial positioning of the projectile 29, and separable mold halves close around a rear portion of the projectile to define, with the projectile and a pull 51, walls of a cavity 55" in which a plastic cartridge casing body is to be formed.

Figure 14A:
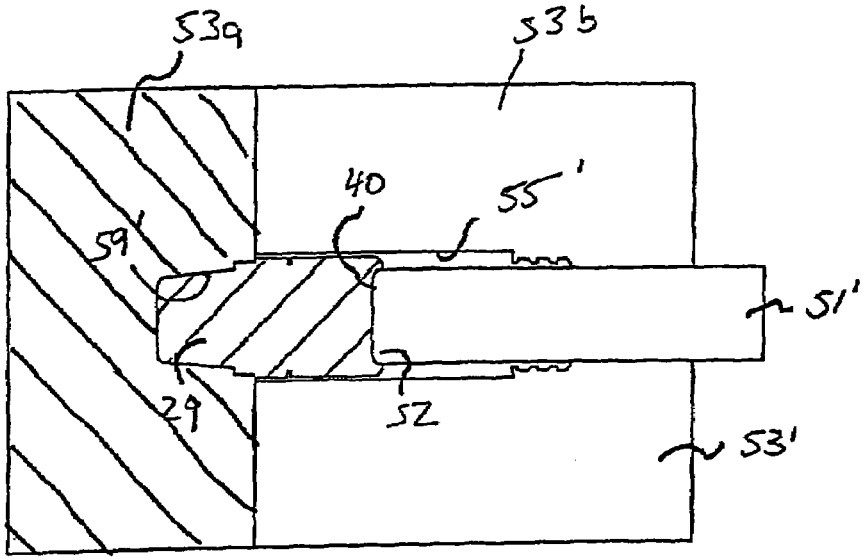
Figure 14B:
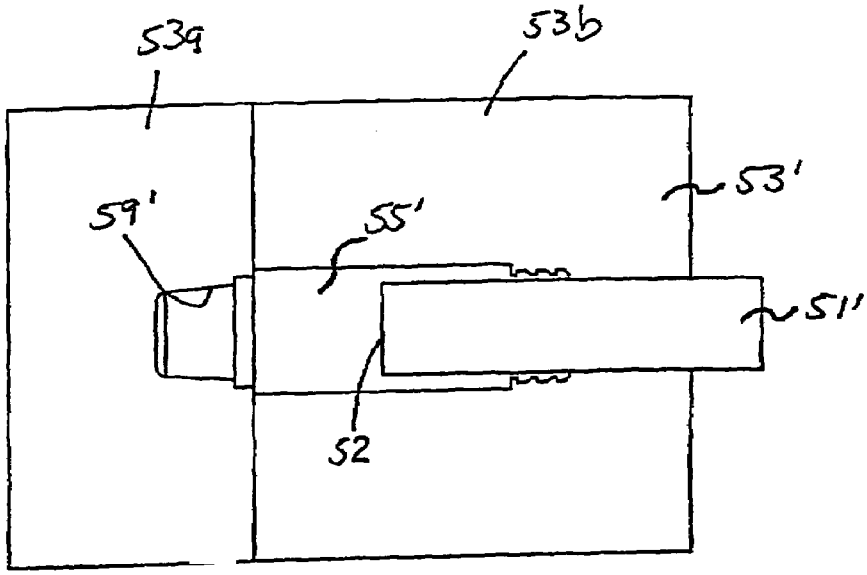

Another form of mold 53' is shown in FIGS. 14A and 14B and, instead of two identical or similar mold halves, such as are used in the embodiment of the method shown in FIGS. 13A and 13B, as seen in FIG. 14A, the mold 53' preferably includes an end 53*a* having a portion 59' in which the front end 57 of the projectile 29 is received and which positions the projectile relative to walls 55' of another end 53*b* of the mold in which a core pull 51' is provided. The core pull 51' is preferably axially movable relative to the end 53*b*. If desired or necessary, the mold end 53*b* may include two separable halves to facilitate removal of the cartridge casing body 23 and the projectile 29 after forming.

Regardless of the mold type used, and as discussed with reference to FIG. 13A, plastic is provided to the cavity 55 to fill voids between the walls of the cavity 55 and the walls of the portion 31 of the projectile, including any exposed portions of the base 40 of the projectile, and the core pull 51 to form the cartridge casing body 23. If one or more recesses 43 are provided in the projectile 29, corresponding flanges 41' are formed when the plastic fills the recesses. Attachment arrangements 41 such as heat bonds, adhesive bonds, and ultrasonic welds may be provided while the projectile 29 and the cartridge casing body 23 reside in the cavity 55, or after removal of the cartridge casing body and the projectile from the cavity, as desired or necessary. Techniques for providing attachment arrangements 41 are well known and will not be further described here. When the cartridge casing body 23 is molded, the core pull 51 is axially drawn from the second interior portion 37 of the cartridge casing body.

Figure 15:
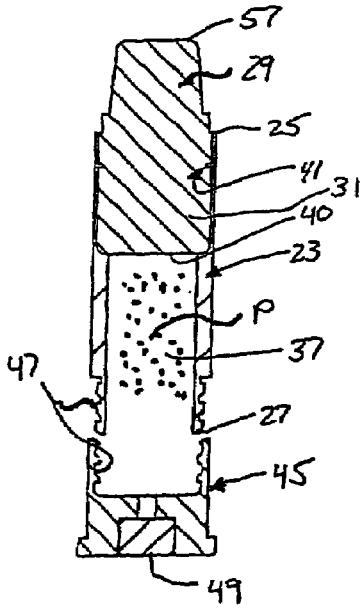
FIG. 15 is a cross-sectional view of an assembly step according to a method for making an ammunition article according to the first embodiment of the present invention.

As seen in FIG. 15, the propellant charge P, such as gunpowder or other propellant, is preferably provided inside of the cartridge casing body 23, generally in the second interior portion 37 of the cartridge casing body, and the base 45 is preferably attached to the second end 27 of the cartridge casing body, preferably following removal of the cartridge casing body and the projectile 29 from the mold 53. If provided, an ignition device such as a primer (FIG. 4B) or an electronic ignition (FIG. 4A) is also provided, or, depending upon the nature of the ignition device, partially provided. If desired or necessary, it is, of course, possible to construct a mold and core arrangement to permit providing the charge P and attachment of the base 45 and primer while the cartridge casing body 23 and the projectile 29 continue to reside in the mold 53.

The base 45 may be a metal, such as brass, base, or may be plastic, composite, ceramic, or a combination of materials. A plastic or composite base 45 is preferably molded separately from the molding operation in which the cartridge casing body 23 is molded, before attachment to the cartridge casing body. The base 45 may be attached to the cartridge casing body 23 by any suitable attachment arrangement technique, such as through a mechanical attachment wherein interconnecting components of the base and the cartridge casing body are fitted together, or by any other suitable technique or combination of techniques. The base 45 may, for example, be attached to the cartridge casing body 23 by an attachment arrangement involving the screwing together of threads on the base with threads on the cartridge casing body. The base 45 may be attached to the cartridge casing body 23 by an attachment arrangement technique involving connecting a tongue and groove arrangement between attachable portions of the base and the cartridge casing body. The base 45 may be attached to the cartridge casing body 23 by an attachment arrangement technique involving forming an interference fit between the cartridge casing body and the base. The base 45 may be attached to the cartridge casing body 23 by an attachment arrangement technique involving adhesive joining. The base 45 may be attached to the cartridge casing body 23 by an attachment arrangement technique involving heat bonding. The base 45 may be attached to the cartridge casing body 23 by an attachment arrangement technique involving ultrasonic welding.

Figure 16:
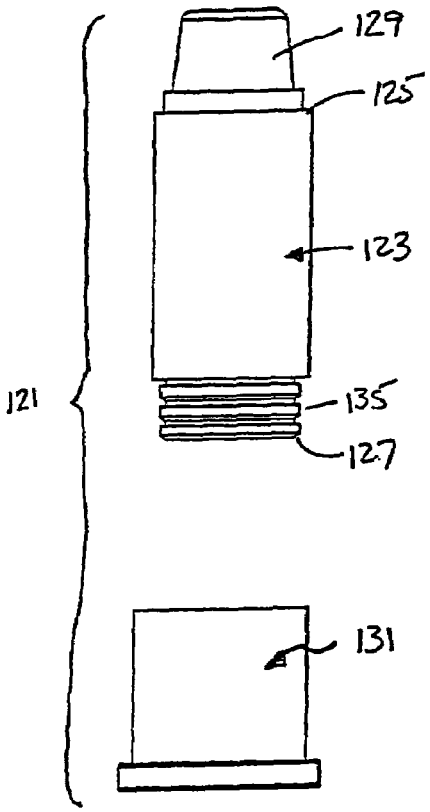
FIG. 16 is an exploded view of an ammunition article according to a second embodiment of the present invention.
Figure 17:
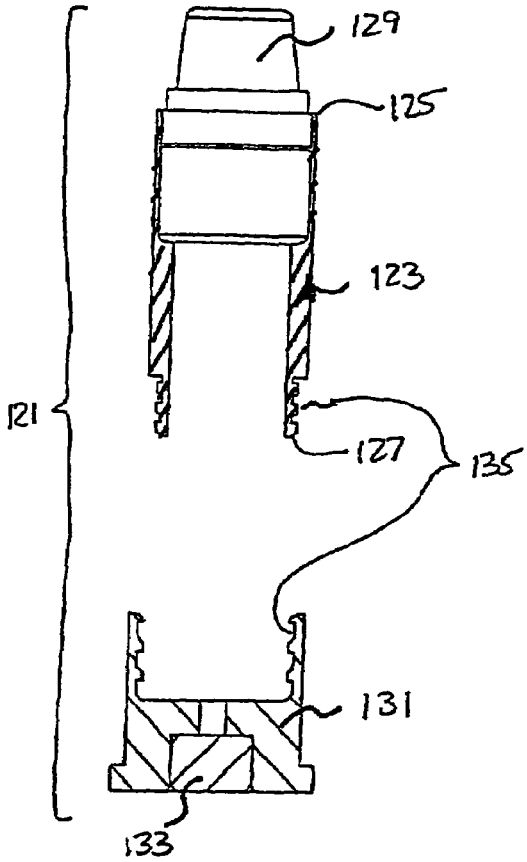
FIG. 17 is an exploded, cross-sectional view of an ammunition article according to the second embodiment of the present invention.
Figure 18A:
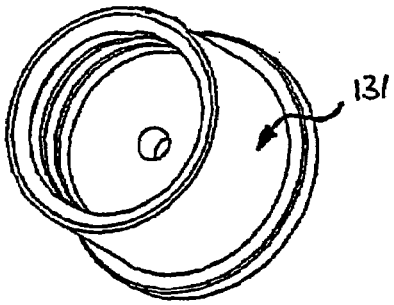
FIG. 18A is a front perspective view of a molded plastic base according to an embodiment of the ammunition article according to the second embodiment of the present invention.
Figure 19:
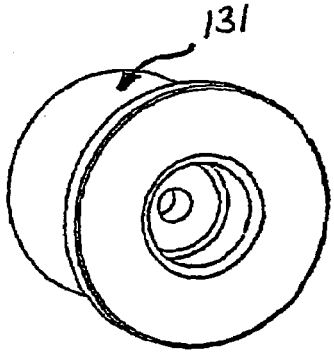
FIG. 19 is a rear perspective view of a molded plastic base according to an embodiment of the ammunition article according to the second embodiment of the present invention.
Figure 18B:
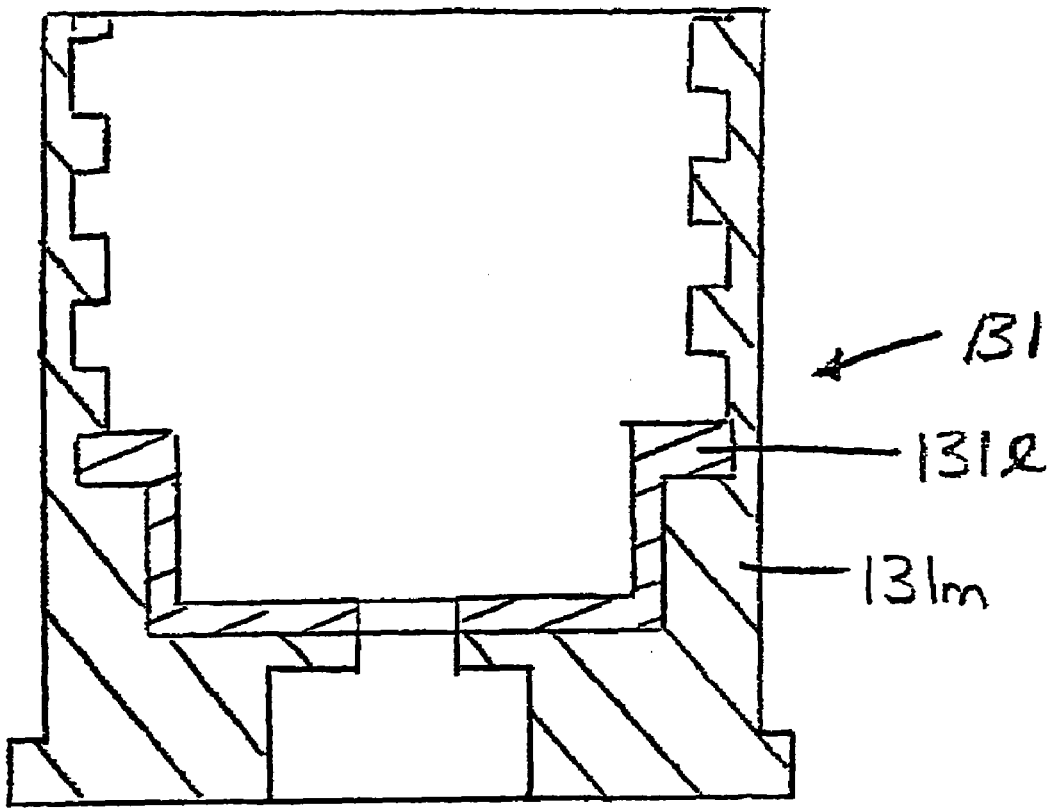
FIG. 18B is a side, cross-sectional view of a molded base according to an embodiment of the ammunition article.
Figure 20:
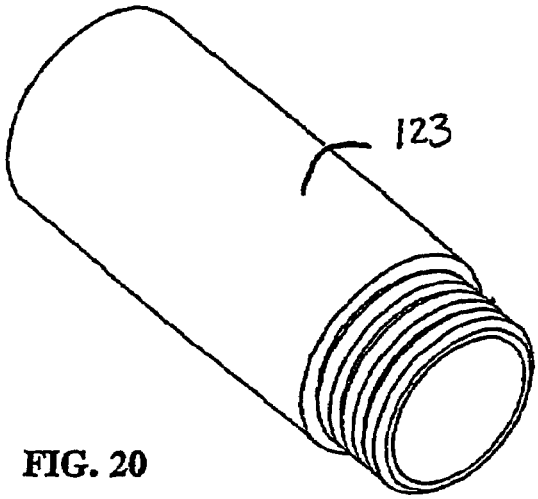
FIG. 20 is a rear perspective view of an embodiment of a cartridge casing body for use with an embodiment of the ammunition article according to the second embodiment of the present invention.

Another embodiment of an ammunition article 121 according to the present invention is shown in an exploded view in FIG. 16 but, when assembled, can appear substantially the same as the ammunition article 21 illustrated in FIGS. 1–3. As seen in FIG. 17, the ammunition article 121 includes a cartridge casing body 123 having a first end 125 and a second end 127. A projectile 129 is attached to the first end 125 of the cartridge casing body 123. A base 131, seen in FIGS. 18A–19, is preferably formed as a single piece of molded plastic, or from a ceramic, a composite, or a combination of plastic, composite, or ceramic, such as, for example, by starting with a ceramic liner 1311 and molding a composite or plastic material 131*m* over the ceramic liner, as seen in FIG. 18B. The base 131 may also incorporate the composite reinforced ceramic technology disclosed in U.S. patent application Ser. No. 08/590,621, which is hereby expressly incorporated by reference. As seen in FIG. 17, the base 131 is attached to the second end of the cartridge casing body. In this embodiment, the cartridge casing body 123 may be a plastic cartridge casing body, such as the plastic cartridge casing body described in connection with FIGS. 1–15, or a metallic cartridge casing body, such as a brass body in which a projectile is installed, as seen in FIG. 20, or which is for a blank cartridge, or a suitable ceramic, composite, or other desired material. The cartridge casing body 123 may also be made of a moldable material that forms part of the propellant pack, i.e., a moldable propellant, or otherwise is itself combustible or consumable by a propellant such as a powder ignition.

A propellant charge is preferably provided inside the cartridge casing body 123 and, as seen in FIG. 17, a device for igniting the propellant, such as a primer 133 or an electronic ignition may be provided, or partially provided, for igniting the propellant. Although the base 131 is a plastic base, the base is preferably made of a sufficiently sturdy material to be reusable although the cartridge casing body 123 may be replaceable. The base 131 is attached to the cartridge casing body 123 by any suitable attachment arrangement 135. The attachment arrangement 135 may, for example, be a mechanical attachment arrangement wherein portions of the base 131 and the cartridge casing body 123 interconnect with each other. Suitable attachment arrangements 135 include screw thread arrangements wherein the base 131 is attached to the cartridge casing body 123 by screw threads, tongue and groove arrangements, an interference fit the cartridge casing body, adhesive, a heat bond, and an ultrasonic weld.

Figure 21:
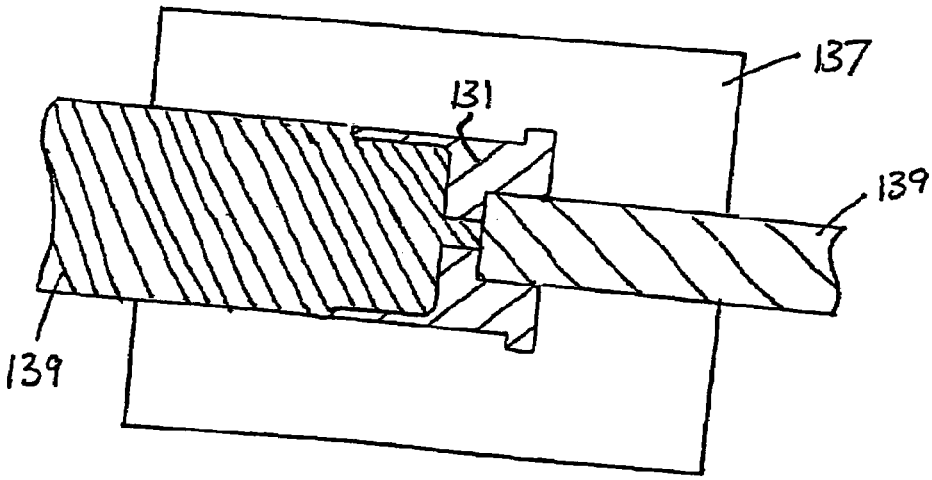
FIG. 21 is a partially cross-sectional view of molding equipment for making a plastic base for an ammunition article according to the second embodiment of the present invention.

The ammunition article 121 is preferably made according to a method as seen in FIG. 21 wherein plastic is molded in a mold 137 around one or more cores 139 to form the single piece, molded plastic base 131. The mold 137 may have two, substantially symmetrical halves, as seen in FIG. 21, that separate in a direction transverse to a longitudinal axis of the base 131, the mold may have two parts that separate in a direction of a longitudinal axis of the base, or the mold may have a single component, with the core 139 closing an end of the single component mold and one or both of the core and the single component mold being movable to permit removal of the base. If desired or necessary, the cartridge casing body or an ignition device or some component of an ammunition article may form part or all of a core around which the base 131 is molded. As seen in FIGS. 16 and 17, preferably after molding, the base 131 is attached to the second end 127 of the cartridge casing body 123 using a suitable attachment arrangement 135. The cartridge casing body 123 may be a molded plastic cartridge casing body, such as the body described with reference to FIGS. 1–15, which is preferably formed in a separate operation from the molding of the base 131, or a metallic cartridge casing body, such as the body shown in FIG. 20. Preferably, before attachment of the base 131 and the cartridge casing body 123, a propellant is provided in the cartridge casing body. A device for igniting the propellant may be provided or partially provided, such as a primer 133 or an electronic ignition, and may be attached or partially attached to the base 131 depending upon the nature of the device.

Figure 22A:
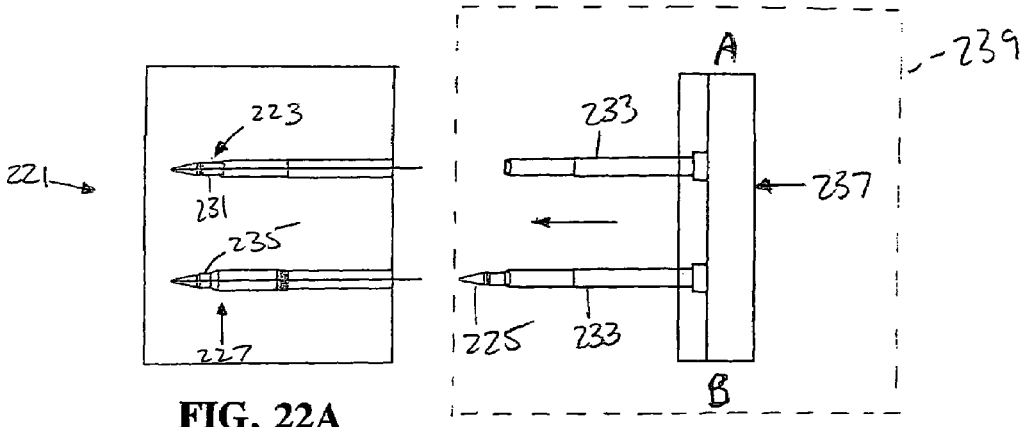
FIGS. 22A–22C schematically show an apparatus and method for manufacturing an ammunition article according to an embodiment of the present invention.
Figure 22B:
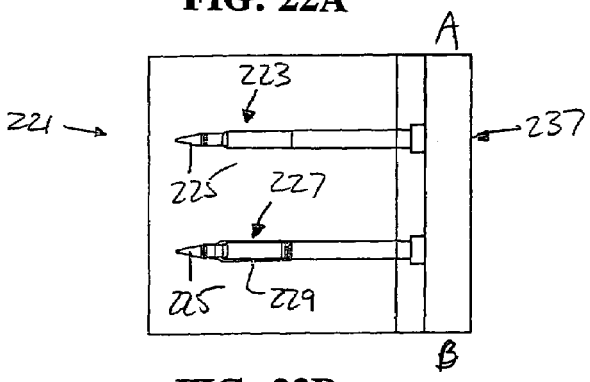
Figure 22C:
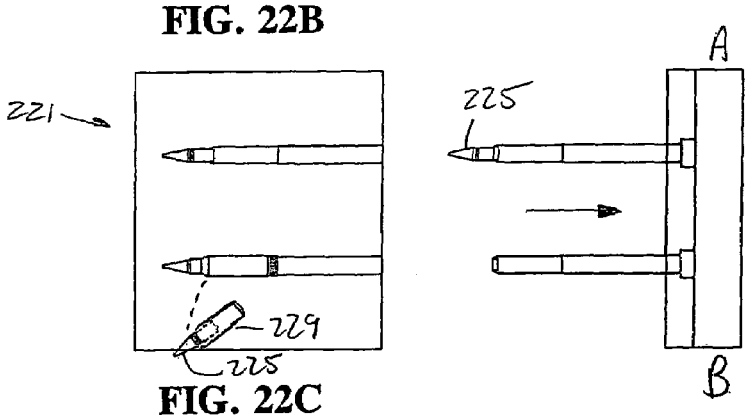

Equipment for and a method for manufacturing any of the ammunition articles discussed herein is shown in FIGS. 22A–22C. The equipment is preferably a single apparatus 221 that includes a first station 223 for forming a projectile 225 and a second station 227 for injection molding a cartridge casing body 229 around at least a portion of the projectile 225.

The apparatus 221 preferably includes one or more first stations 223 and a corresponding number of second stations 227. Each first station 223 includes a projectile mold cavity 231 for receiving a core pull 233 and for forming a projectile 225 in the volume defined by the core pull and the cavity. Each second station includes a casing mold cavity 235 for receiving a core pull 233 on which a projectile 225 is disposed and for forming the cartridge casing body 229 around the projectile and part of the core pull 223. The core pull 233 is preferably one of a plurality of core pulls mounted on a rotatable conveyor or frame 237 that is rotatable and movable in a direction of the axes of the core pulls 233 relative to the mold cavities 231 and 235. There are preferably as many core pulls 233 as there are first stations 223 and second stations 227 combined.

The casing mold cavity 235 is preferably larger in diameter than the projectile mold cavity 231 so that the cartridge casing body 229 is formed around the core pull 233 while, when the core pull is disposed in the mold cavity 231, no space is defined between the core pull and the mold cavity so that the projectile is formed entirely in the space in the mold cavity 231 above the core pull 233.

The projectile 225 is molded in any suitable fashion, such as by injecting heated metallic pellets or molten metal into the mold cavity 231. After the projectile 225 is formed, the core pull 233 is withdrawn from the mold cavity 231 with the projectile 225 that has been formed at its leading end. The frame 237 is rotated, preferably 180°, and the core pull 233 with the projectile 225 at its end is inserted into the casing mold cavity 235 as seen in FIG. 22A. As seen in FIG. 22B, when the core pulls 233 are in the mold cavities 231 and 235, a projectile 225 is formed in a space defined by the core pull 233 and the cavity 231 and the casing 229 is formed around a projectile 225 and the core pull 233 in the cavity 235. The frame 237 is shown here as having reference points A and B. The frame 237 is moved to withdraw the core pulls 233 from the cavities 231 and 235 as seen in FIG. 22C so that a projectile 225 is disposed at the end of one of the core pulls and so that the projectile around which a casing 229 has been molded can be ejected or otherwise moved on for further processing. Then the frame 237 is rotated, preferably through 180°, so that the reference points A and B switch locations. The process is then repeated exactly as before. If the projectile 225 is at an elevated temperature after forming, the projectile is preferably cooled during transportation to the second station 227 such as by waiting a suitable amount of time for the temperature to drop and/or by using a suitable cooling apparatus 239.

Upon start-up of the apparatus, there will not, of course, be a projectile 225 at the end of one of the core pulls 233, unless it is placed there manually. If there is no projectile 225 placed at the end of the core pull when it is received in the mold cavity 235, a part formed entirely of the material for forming the casing 229 will be formed in the cavity defined by the mold cavity 235 and the core pull 233.

The apparatus 221 preferably consolidates at least previously separate apparatus for making a projectile and apparatus for attaching a cartridge casing body to the projectile. It will be appreciated that the apparatus 221 can have many cavities 231 and 235, and many core pulls 233, so that a plurality of ammunition articles can be formed at once. The apparatus 221 according to the present invention can occupy substantially less space than is required by two separate apparatus, and can make projectiles continuously and at a high speed whereas, in the past, manufacture of projectiles was entirely divorced from manufacture of cartridge casing bodies and other components of an ammunition article.

It will be appreciated that the various components of the ammunition article made according to the present invention can be made of a variety of materials. For example, the projectile, the cartridge casing body, the base, and any other components of the ammunition article may be made of, for example, a polymer, a metal, or a composite material.

In addition to the preference that the casing be made of a modified ZYTEL resin, it is desirable to provide a material that tends to lubricate the casing relative to a chamber from which a projectile is to be fired. For example, when a chamber of a gun becomes hot, it has been observed that the plastic casing tends to occasionally become stuck in the chamber after firing the projectile and withdrawing the bolt, even though the base of the ammunition article is withdrawn. This is believed to occur because the higher temperatures in the chamber softens the plastic casing material sufficiently to weaken force need to break the joint between the casing and the base, and because compression of a gap between a forward shoulder of the casing and the chamber tends to cause a suction cup effect. It is presently preferred to include a non-stick material such as TEFLON or KRYTOX, available from E.I. DuPont De Nemours Co., with the ZYTEL material. Other suitable non-stick materials include silicon. The non-stick material may be formed as part of the ZYTEL material, which is preferably used to form the casing material. If desired or necessary, a TEFLON, KRYTOX, or other non-stick coating can be provided on an outside of the finished projectile.

Figure 23:
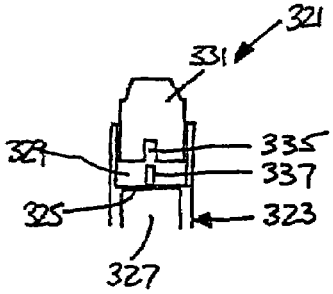
FIG. 23 is a side, cross-sectional view of a portion of an ammunition article according to a fourth embodiment of the present invention.

Yet another embodiment of an ammunition article 321 is shown in an. exploded view in FIG. 23. The ammunition article 321 includes a molded plastic cartridge case body 323. The cartridge case body 323 includes a web 325 dividing an internal volume of the body to define a lower cavity 327 for receiving a propellant and an upper cavity 329 for receiving a projectile 331. The web 325 includes an upwardly extending prong 333 for being received in a corresponding recess 335 in a base 337 of the projectile 331 to fasten the cartridge casing body 323 to the projectile. The prong 333 may be attached in the recess 335 by any suitable attachment arrangement and attachment technique, such as by an interference fit, by interlocking structures on the prong and the recess, by an adhesive, by heat bonding, and by ultrasonic welding. The cartridge casing body 323 may, of course, be molded around the projectile 331 in a manner similar to the manner in which the cartridge casing body 23 is molded around the projectile 29, except that a core pull would not extend all the way to a base of the projectile. The prong 333 may be formed by causing plastic to enter the recess 333 during the molding operation. Alternatively, the cartridge casing body 323 may be formed in a separate molding operation and thereafter attached to the projectile 331 such that the prong 333 is caused to enter the recess 335. A base (not shown) may be attached by a suitable attachment arrangement in the same way that the base 45 is attached to the cartridge casing body 23, and a propellant charge (not shown) and a propellant ignition device (not shown) may be provided in the same was as with the ammunition article 21. U.S. Pat. Nos. 5,033,386 and 5,151,555 disclose plastic cartridge cases having a web extending across a body of the cartridge cases and are hereby expressly incorporated by reference.

Figure 24:
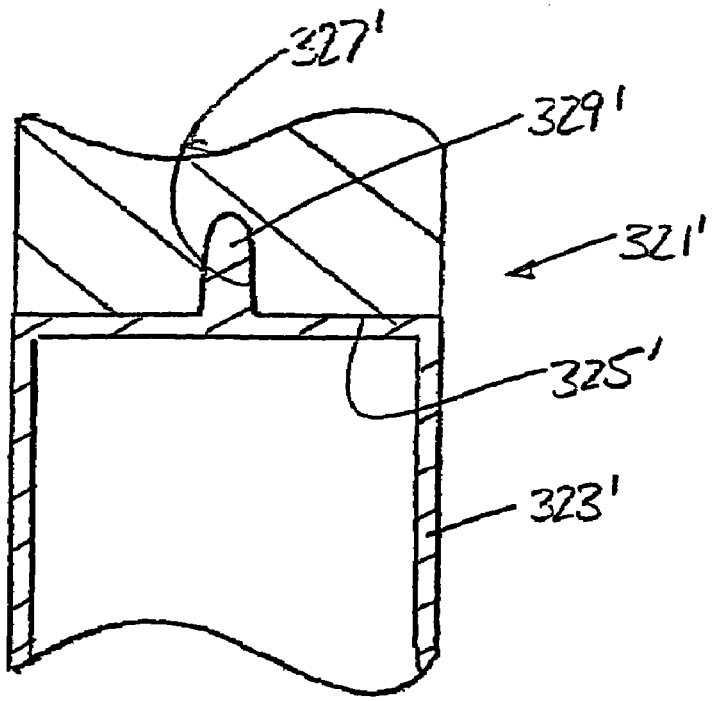
FIG. 24 is a side, cross-sectional view of a portion of an ammunition article according to a fifth embodiment of the present invention.

FIG. 24 discloses yet another embodiment of an ammunition article 321' including a plastic cartridge casing body 323'. The body 323' is molded to conform with a bottom end 325' of the projectile in which a recess 327' is provided such that a protrusion 329' is molded in the recess and, preferably, the walls of the body do not extend up the sides of the projectile. This embodiment of the ammunition article 321' facilitates use of a combustible cartridge casing body 323', such as where the cartridge casing body itself forms part of the propellant pack. Where the cartridge casing body 323' is intended to be part of the propellant pack, the base is preferably adapted to expand during firing to form a gas seal. As desired or necessary, the base may be a metal base, such as a brass base, or a plastic material base, a ceramic base, a composite base, a combination of plastic, composite, or ceramic, or may incorporate the composite reinforced ceramic technology disclosed in U.S. patent application Ser. No. 08/590,621, which is expressly incorporated by reference.

Figure 25:
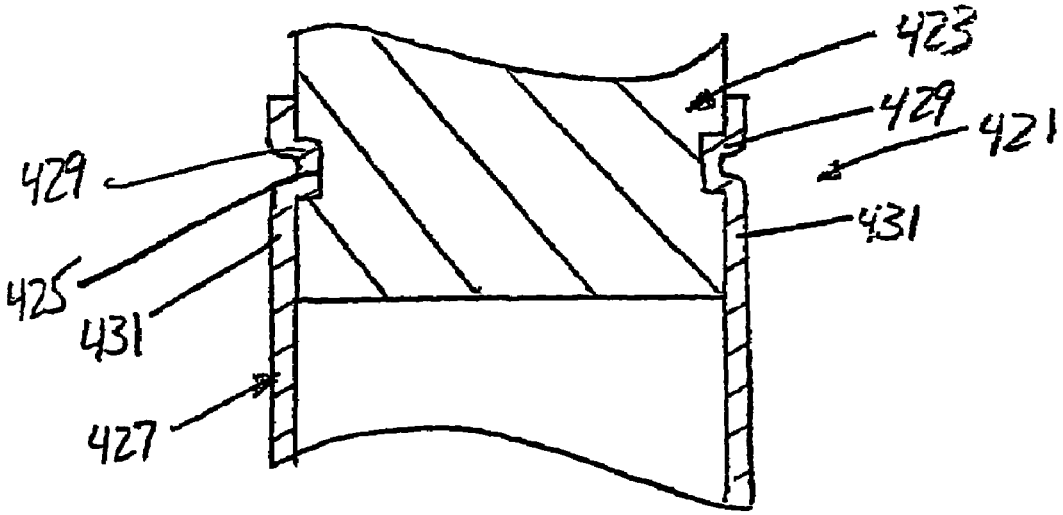
FIG. 25 is a side, cross-sectional view of a portion of an ammunition article according to a sixth embodiment of the present invention.

Yet another embodiment of an ammunition article 421 according to the present invention is seen in FIG. 25 and comprises a projectile 423 having cannelure contours 425 and a molded cartridge casing body 427 molded around at least a portion of the projectile such that a portion 429 of a wall 431 of the cartridge casing body follows the cannelure contours of the projectile. The portion 429 of the wall 431 preferably has a substantially constant thickness such that, where the projectile is recessed, the portion of the wall is also recessed.

The foregoing embodiments of the present invention are all believed to be useful for use with all types of cartridges or blanks, regardless of shape. For example, in all of the embodiments, the cartridge casing body may be, for example, cylindrical, bottle-shaped, or have other suitable shapes as desired or necessary.

While this invention has been illustrated and described in accordance with a preferred embodiment, it is recognized that variations and changes may be made therein without departing from the invention as set forth in the claims.

What is claimed is:

1. A method of manufacturing an ammunition article, comprising:

forming a projectile of an ammunition article at a first station of an apparatus;

transporting the projectile within the apparatus to a second station of the apparatus;

injection molding at the second station a cartridge casing body of the ammunition article around at least a portion of the projectile.

2. The method as set forth in claim 1, wherein the projectile is formed by injection molding.

3. The method as set forth in claim 1, wherein the projectile is formed from at least one of a polymer, a metal, and a composite material.

4. The method as set forth in claim 1, wherein the cartridge casing body is formed from at least one of a polymer, a metal, and a composite material.

5. The method as set forth in claim 1, comprising cooling the projectile with a cooling apparatus during transportation from the first to the second station.

6. The method as set forth in claim 1, wherein the cartridge casing body is formed by insert injection molding.

7. The method as set forth in claim 1, wherein the cartridge casing body is molded to have a first end to which the projectile is attached and a second end.

8. The method as set forth in claim 1, wherein the cartridge casing body is molded around a core pull such that the core pull and a portion of the projectile define an interior volume of the cartridge casing body, the method comprising the further step of removing the core pull from the cartridge casing body.

9. The method as set forth in claim 8, wherein the core pull has a smaller diameter than the portion of the projectile such that the interior volume of the cartridge casing body includes a first interior portion defined by the portion of the projectile and a second interior portion having a smaller diameter than the first interior portion and being separated from the first interior portion by a shoulder, the shoulder being of sufficient size to prevent axial movement of the projectile into the second interior portion.

10. The method as set forth in claim 1, wherein the projectile is formed to have a recess therein, and the cartridge casing body is molded around the projectile such that material from which the cartridge casing body is formed enters the recess and forms a flange on the cartridge casing body extending into the recess.

* * * * *